US010618611B2

(12) United States Patent
Rezzonico et al.

(10) Patent No.: US 10,618,611 B2
(45) Date of Patent: Apr. 14, 2020

(54) FENDER FOR BOATS

(71) Applicant: TESSILMARE s.r.l., Capiago Intimiano (IT)

(72) Inventors: Margherita Rezzonico, Sirtori (IT); Ranieri Rezzonico, Sirtori (IT)

(73) Assignee: TESSILMARE S.R.L., Capiago Intimiano (IT)

( * ) Notice: Subject to any disclaimer, the term of this patent is extended or adjusted under 35 U.S.C. 154(b) by 0 days.

(21) Appl. No.: 16/002,035

(22) Filed: Jun. 7, 2018

(65) Prior Publication Data

US 2018/0354593 A1 Dec. 13, 2018

(30) Foreign Application Priority Data

Jun. 8, 2017 (IT) ..... 202017000063068
Oct. 2, 2017 (IT) ..... 202017000110142

(51) Int. Cl.
*B63B 59/02* (2006.01)

(52) U.S. Cl.
CPC ..... *B63B 59/02* (2013.01)

(58) Field of Classification Search
CPC ..... B63B 59/00; B63B 59/02
USPC ..... 114/219
See application file for complete search history.

(56) References Cited

U.S. PATENT DOCUMENTS

| | | | | |
|---|---|---|---|---|
| 4,970,980 | A | 11/1990 | Eisner | |
| 7,430,978 | B2 | 10/2008 | Rezzonico | |
| 8,839,731 | B2 | 9/2014 | Rezzonico | |
| 2004/0200397 | A1* | 10/2004 | Klein | B63B 59/02 114/219 |
| 2010/0077953 | A1 | 4/2010 | Simard et al. | |
| 2016/0355243 | A1 | 12/2016 | Hynes et al. | |

* cited by examiner

*Primary Examiner* — Lars A Olson
(74) *Attorney, Agent, or Firm* — Jacobson Holman, PLLC

(57) ABSTRACT

A fender for boats consisting of a base made of plastic material, able to be fixed to a hull of a boat, and an insert able to be coupled by a lock joint to said base. The insert is composed of a profile made of metal material and a core made of plastic material and is removably coupled by the lock joint to the base.

19 Claims, 6 Drawing Sheets

FENDER FOR BOATS

BACKGROUND OF THE INVENTION

The present invention relates to an improved fender for boats.

The protection of the hull of boats, especially luxury boats, represents a need which is particularly felt in sailing.

During docking maneuvers, even expert navigators touch the berthing structure, which does not always have fenders able to absorb impacts.

At the same time, the need is felt to produce fenders which are easily coupleable to the boat, particularly when the hull has significant curvatures. Assembly is often difficult, especially in the bow and stern area where the curvature is more accentuated.

PRIOR REFERENCES

U.S. Pat. No. 7,430,978 by the present applicant describes a fender for boats consisting of an inner portion with an H-profile to be fixed to the hull, and an outer portion coupleable to said inner portion and able to absorb impacts. The inner part is made of rigid PVC, while the outer part is made of soft PVC. Said inner and outer portions are coupled loosely, in other words, the outer portion can also move even after coupling.

The present applicant is also the proprietor of U.S. Pat. No. 8,839,731, which describes a fender for boats comprising a steel laminated profile with an open section consisting of an outer cap connected to the ends with two containing, parallel rectilinear rest stretches, converging towards the center of the cap without meeting, able to rest on the edge of the boat. Said laminated profile is filled internally with a core made of PVC. Said profile comprises holes for fixing to the hull by screws. Said profile is particularly robust, but requires fixing screws, which makes it difficult to associate with the hull and remove. The screws further penalize the esthetics of the product designed above all for luxury boats.

U.S. Pat. No. 4,970,980 describes a fender for jet skis consisting of a base for connecting to the hull and an outer elastic profile, which is coupled by lock joint to said base. Said outer elastic profile is inflatable.

US-2010/0077953 shows a fender for jet skis comprising an outer profile, which is coupled by lock joint to a base fixed to the hull. Said outer profile has two winged hooking portions of the base, said portions being housed in an internal channel, which is made after the coupling.

US-2016/0355243 describes a fender for boats comprising a base fixed to the hull and an insert coupleable by lock joint to said base by a V-shaped coupling portion, which is inserted into a channel of said base.

US-2004/0200397 shows a fender for boats comprising a base fixed to the hull and an insert coupleable by lock joint to said base by two coupling portions, able to interact with wings of said base.

Disadvantageously, the lock joint couplings of the aforesaid antecedence require elevated precision both in the manufacturing of the pieces and in the assembly.

Said precision requirement means elevated manufacturing costs and unexpected breakages in the assembly step.

A further problem is represented by the fact that the elements composing said lock joint couplings are made of plastic material, in particular the outer element designed to be knocked. The result is fenders subject to breaking, which have to be replaced regularly.

BRIEF SUMMARY OF THE INVENTION

It is an object of the present invention to produce a modular fender for boats, which is simple to build and flexible to use.

A further object of the present invention is that said fender is robust, stable and ensures an appreciable esthetic result.

Advantageously, the insert is robust, but can easily be removed for maintenance and replacements because the coupling of the insert with the base is performed simply by lock joint, without separate fixing means, such as screws, rivets or similar.

The lock joint coupling ensures the seal both in the direction of the axis of the fender, and in a direction orthogonal to said axis.

Advantageously, the flexibility of the protrusions of the core allows a quick assembly.

DESCRIPTION OF THE DRAWINGS

These and other features of the present invention will become clearer from the following detailed description of practical embodiments thereof, illustrated by way of a non-limiting example in the following attached drawings, wherein.

DETAILED DESCRIPTION OF THE INVENTION

A fender 1 for boats consists of a base 2 able to be fixed to a hull of a boat by known fixing means, for example screws, and an insert 3 able to be coupled by lock joint to said base 2.

Figure 3:
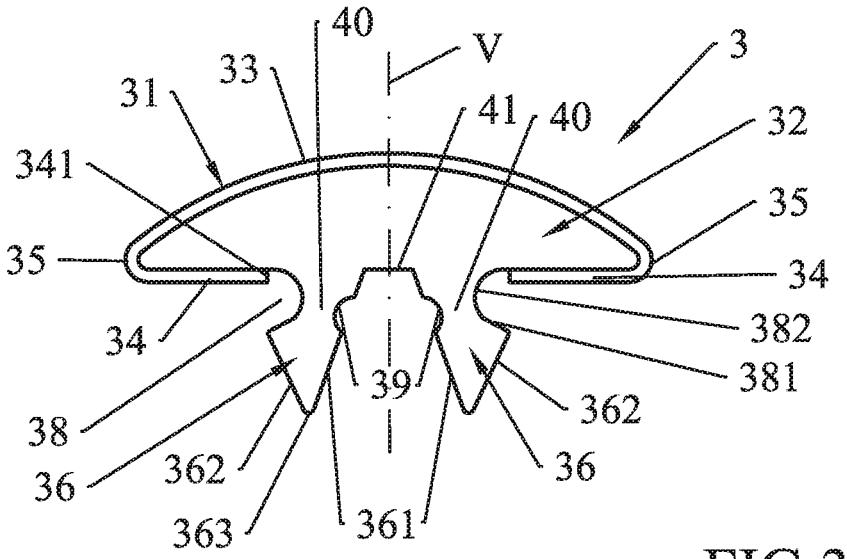
FIG. 3 shows a vertical section view of an insert of the fender of FIG. 1.
Figure 4:
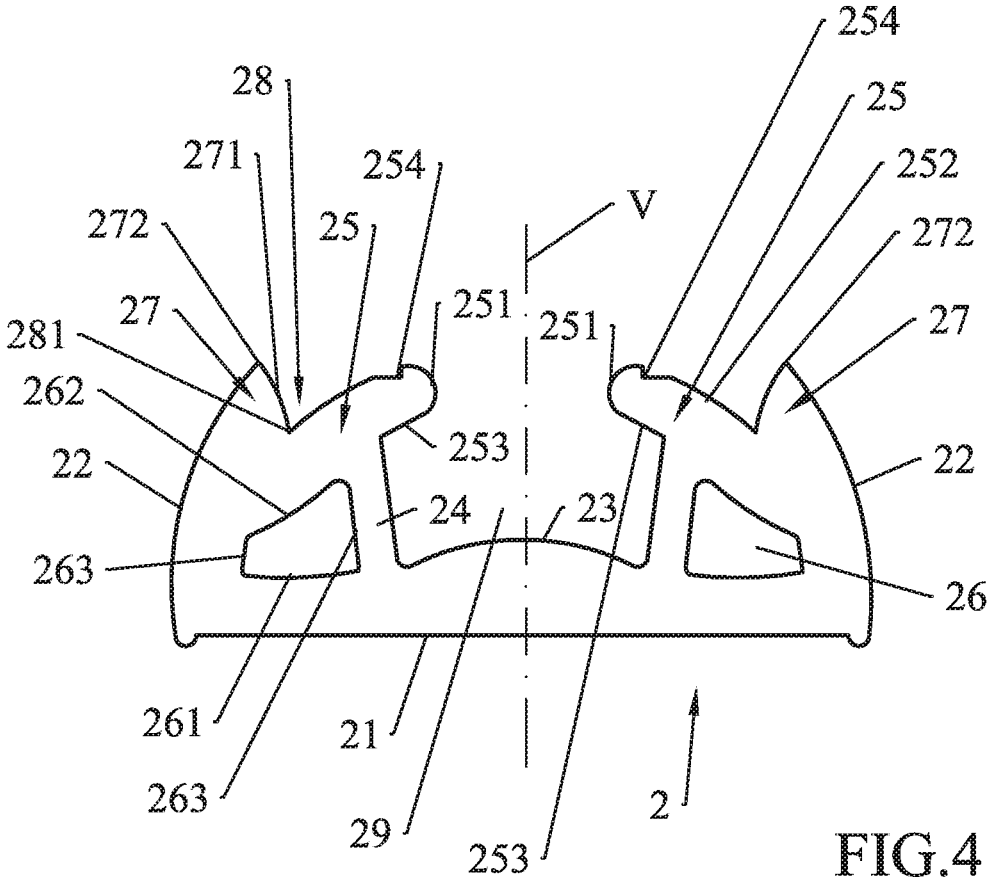
FIG. 4 shows a vertical section view of a connection base of the fender of FIG. 1.
Figure 5:
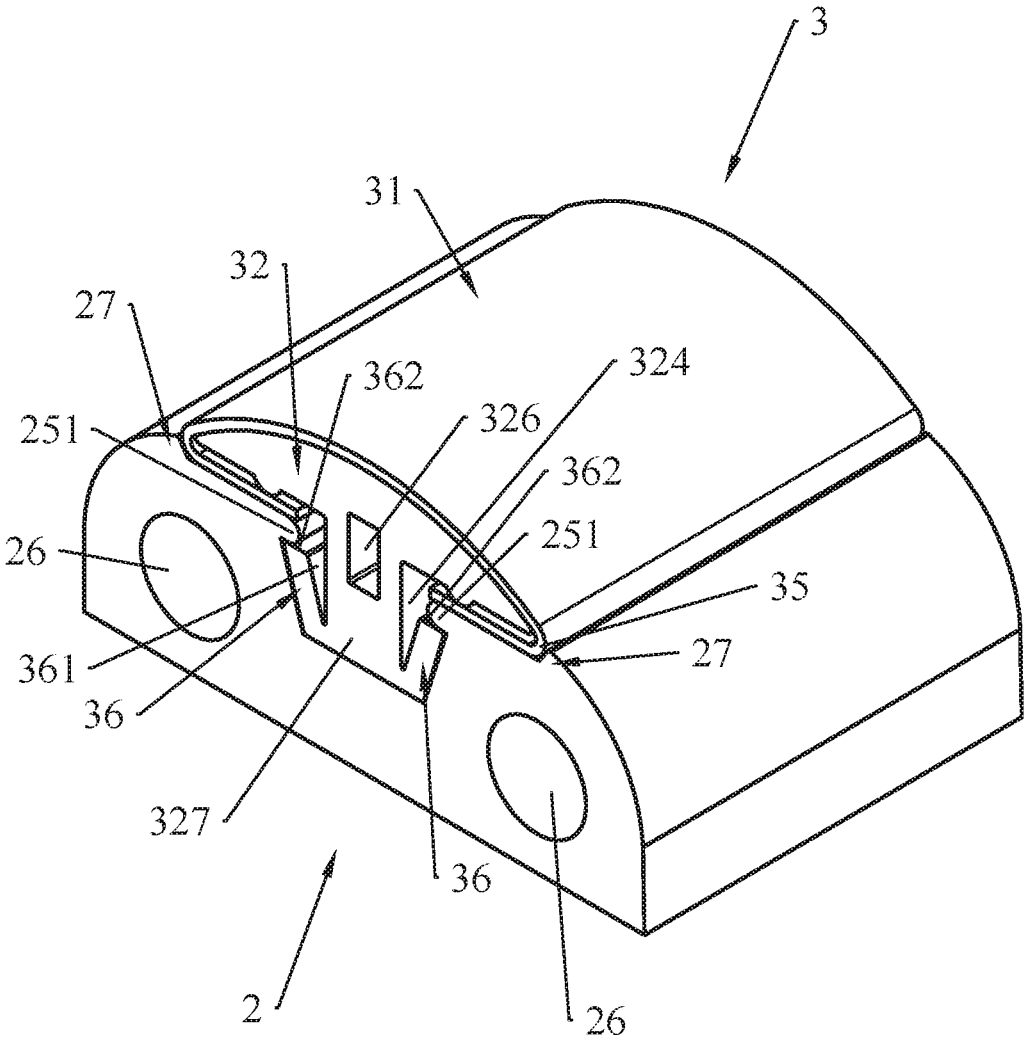
FIG. 5 shows a perspective view of a fender according to a second embodiment.

According to a first embodiment of the invention (FIGS. 1-4), as clearly visible by observing FIG. 4 in particular, said base 2 comprises a rectilinear portion 21 able to rest on the hull, two curved lateral portions 22 and a curved central portion 23. Said rectilinear portion 21 is able to bend, thus adapting to the curvature of the hull.

Inclined bands 24 and connection protrusions 25, together with said curved lateral portions 22 and said rectilinear portion 21, define closed lateral cavities 26.

The base 2 comprises an axis of symmetry V, which cuts said rectilinear portion 21 in half.

Each connection protrusion 25, in the section view of FIG. 4, comprises a curved end 251, a rectilinear stretch 253 for connecting to the inclined band 24, and a curved stretch 252, which terminates in a lateral wing 27.

The base 2 comprises two lateral wings 27, each of which is formed by one end 221 of said curved lateral portion 22 and a curved stretch 271, which meet, forming a tip 272, preferably a chamfered tip.

Each connection protrusion 25 and the respective wing 27 determine an open lateral cavity 28, which comprises a lower inflection point 281.

Each curved stretch 252 connects to each curved end 251 by a tooth 254.

Said tooth 254 is formed by two rectilinear stretches, perpendicular to each other.

Each cavity 26, in section according to FIG. 4, is delimited by a lower curved stretch 261 and an upper curved stretch 262, which are connected by two straight stretches 263.

Said straight stretches 263 preferably have a different length; said curved stretches 261, 262 have a different curvature.

The cavity 26 widens towards the axis V (FIG. 4).

The curved central portion 23, the lateral bands 24 and the connection protrusions 25 form a central open cavity 29.

Each lower curved stretch 261 has an opposite concavity to the concavity of the curved central portion 23.

The base 2 is made of plastic material, for example PVC, flexible and elastic, which makes it easily adaptable to any curve of the hull of the boat.

With particular reference to FIG. 3, the insert 3 is composed of a profile 31 in stainless steel and a core 32 made of plastic material, for example PVC.

Figure 1:
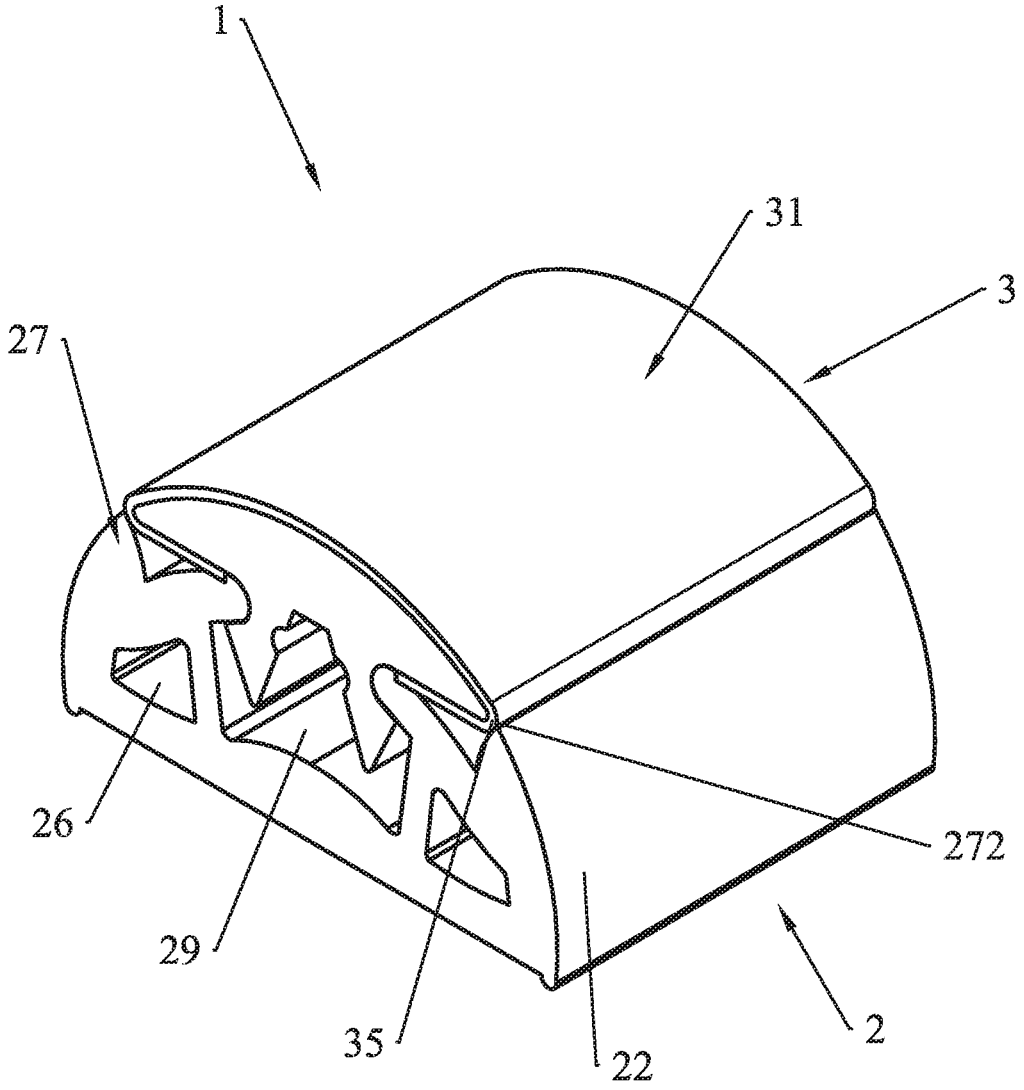
FIG. 1 shows a perspective view of a fender according to a first embodiment of the invention.
Figure 2:
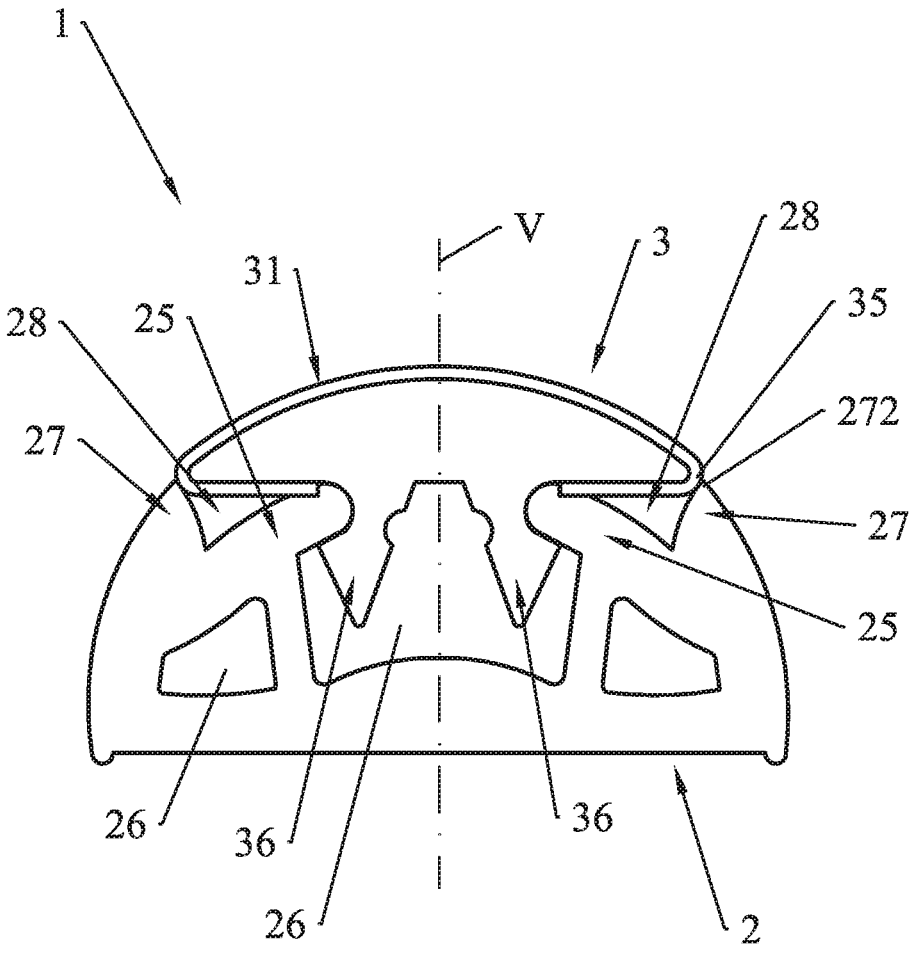
FIG. 2 shows a vertical section view of the fender of FIG. 1.

The profile 31 is formed by a curved stretch 33 and two rectilinear stretches 34 converging towards the same axis of symmetry V as the base 2, as noted in FIG. 2 in which the insert 3 and the base 2 are coupled.

The curved stretch 33 is connected with continuity to each rectilinear stretch 34 by connections 35, which are preferably rounded.

The core 32 has an edge, which follows the profile 31, where it covers it up to the ends 341 of the rectilinear stretches 34.

The core 32 comprises two connection protrusions 36, substantially in a V, which develop between said ends 341 of the profile 31.

Each protrusion 36 comprises an inner rectilinear stretch 361 and an outer rectilinear stretch 362, which meet in a connection 363, preferably rounded.

Each outer rectilinear stretch 362 joins the profile of the core 32 covered by the profile 31 by outer grooves 38, each of which consists of a straight stretch 381 and a curved stretch 382.

Inner grooves 39, able to interrupt said inner rectilinear stretch 361, define constrictions 40 of the protrusions 36 along with said outer grooves 38.

Note that the term "inner" indicates an element facing the axis V, the term "outer" an element facing in the opposite direction.

Said protrusions 36 are connected by a rectilinear stretch 41 parallel to said rectilinear stretches 34 of the profile 31.

In FIG. 2 the insert 3 can be seen coupled by lock joint to the base 2.

The coupling is performed by forcing the insertion of the protrusions 36 of the insert 3 into the cavity 29 of the base 2, so that the curved end 251 of the protrusions 25 of the base 2 engage with the outer grooves 38 of the insert 3.

In particular, note that the straight stretches 381, 253 and the curved stretch 382 are coupled to one another with the curved end 251.

The coupling is complete when each end 341 of the profile 31 is coupled to the respective tooth 254.

Advantageously, each connection 35 of the profile 31 substantially rests on the tip 272 of the respective wing 27.

When the coupling is complete, the cavities 28 of the base 2 are substantially closed by the insert 2.

The cavities 28 allow an improvement in the deformability of both the wings 27 and the protrusions 25, both in the step of coupling and in the step of absorbing the impacts.

In the latter case, the connection 35, which is more rigid than the wing 27, will tend to slip inside the cavity 28 because the wing 27, which is softer, deforms along with the underlying part due to the closed cavities 26.

The teeth 254, precisely at the ends 341 of the steel edge, make the coupling more solid: the insert 3 is unable to slip out of the base 2 accidentally.

The profile 31 does not cover the connection area of the protrusions 36, which thus remain particularly deformable, allowing easy hooking/unhooking.

Advantageously, the resting of the profile 31 on the wings 27 allows a substantial continuity in the outer edge of the fender 1 to be obtained, partly by the insert 3, in other words, the element most subject to impacts, and partly by the base 2.

Should the cavities 28 deform permanently in time, preventing the connection 35 from resting on the tip 272 in rest conditions, in case of impacts, the fender 1 would still perform its function because the connection 35 would tend to touch the wings 27 sliding again along the curved stretch 271.

The constrictions 40 facilitate the deformability of the protrusions 36 without compromising the soundness of the coupling.

The profile 31 thus embraces the core 32 until the ends 341 of the rectilinear stretches 34, the protrusions 36 of the core 32 extending between said ends 341.

FIGS. 5-8 show a second embodiment of the invention.

The fender 1 still consists of a base 2 able to be fixed to a hull of a boat by known fixing means, for example screws, and an insert 3 able to be coupled by lock joint to said base 2.

Figure 8:
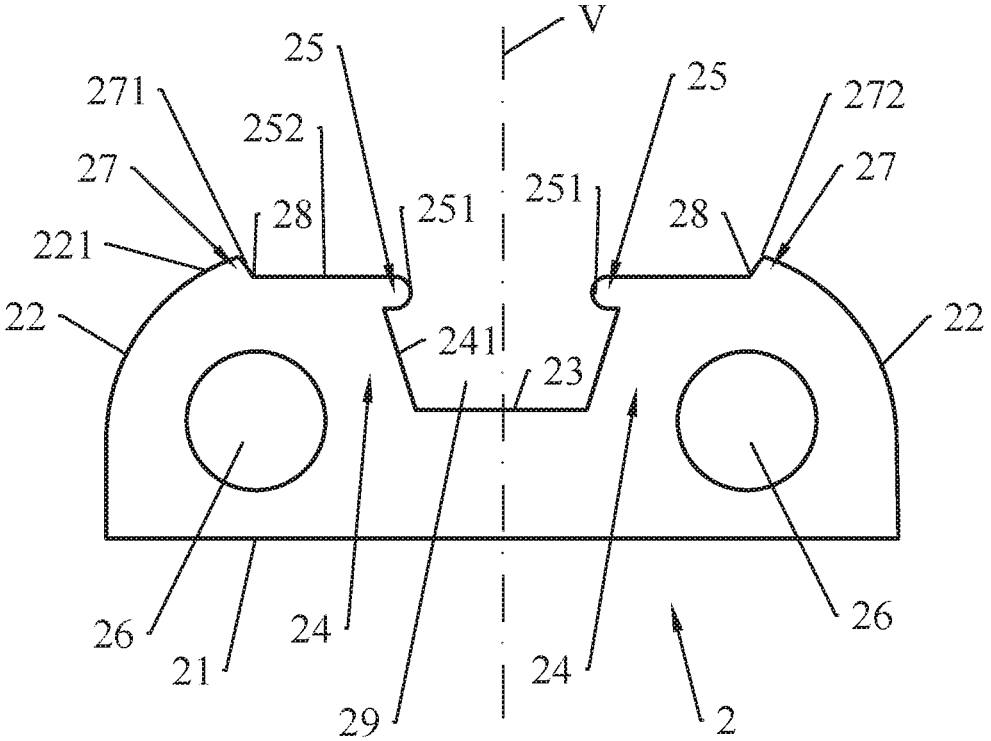
FIG. 8 shows a vertical section view of a connection base of the fender of FIG. 5.

As clearly visible by observing FIG. 8 in particular, said base 2 comprises a first rectilinear portion 21 able to rest on the hull, two curved lateral portions 22 and a second rectilinear portion 23. Said rectilinear portion 21 is able to bend, thus adapting to the curvature of the hull.

Inclined bands 24 and connection protrusions 25, together with said curved lateral portions 22 and said rectilinear portion 21, define closed lateral cavities 26, preferably with a circular section.

Said inclined bands 24 give rise to inclined stretches 241, which terminate at the bottom in said second rectilinear portion 23.

The base 2 comprises an axis of symmetry V, which cuts said rectilinear portions 21, 23 in half.

Each connection protrusion 25, in the section view of FIG. 4, comprises a curve 251, which continues in the inclined band 24 at the bottom, while it continues at the side along a straight stretch 252 up to a lateral wing 27.

The base 2 comprises two lateral wings 27, each of which is formed by one end 221 of said curved lateral portion 22 and by a straight stretch 271, which meet, forming a tip 272 which is preferably chamfered.

Each connection protrusion 25 and the respective wing 27 determine a step 28.

Each curve 251 approximately draws a semi-circle.

The radius of said semi-circle is less than a quarter of the length of each straight stretch 252.

The base 2 is made of plastic material, for example PVC, flexible and elastic, which makes it easily adaptable to significant curves of the hull of the boat, in other words with curvature radii greater than, or equal to 150 mm, preferably greater than, or equal to 250 mm.

Figure 7:
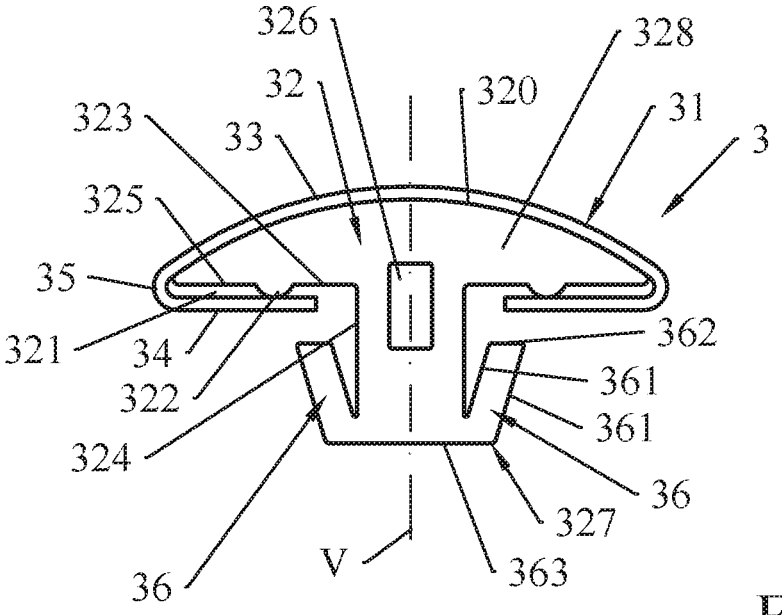
FIG. 7 shows a vertical section view of an insert of the fender of FIG. 5.

With particular reference to FIG. 7, the insert 3 consists of a profile 31 made of stainless steel and a core 32 made of plastic material, for example PVC.

Figure 6:
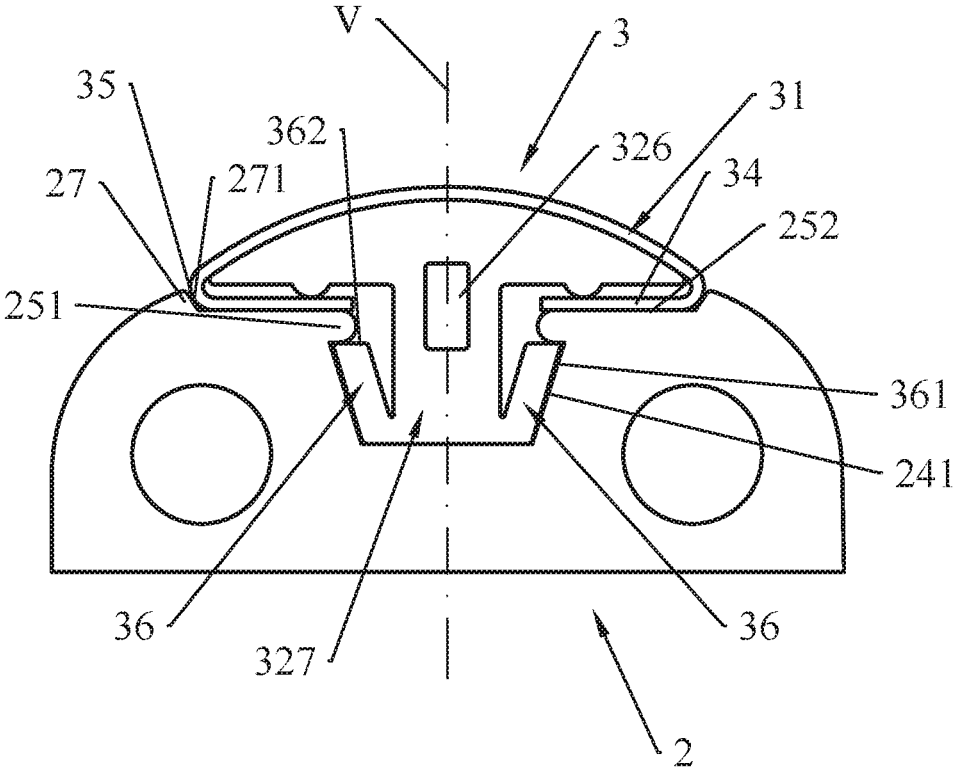
FIG. 6 shows a vertical section view of the fender of FIG. 5.

The profile 31 is formed by a curved stretch 33 and two rectilinear stretches 34 converging towards the same axis of symmetry V as the base 2, as noted in FIG. 6, in which the insert 3 and the base 2 are coupled.

The curved stretch 33 is connected with continuity to each rectilinear stretch 34 by connections 35, which are preferably rounded.

The core 32 has a curved edge 320, which follows the curved stretch 33 of the profile 31 with contact.

A space 321 is provided, at each rectilinear stretch 34 of the profile 31, between said rectilinear stretch 34 and the core 32, interrupted by a rest protrusion 322, which is preferably curved.

The core 32 continues with a rectilinear stretch 323 beyond said protrusion 322, which is joined at 90° to a straight stretch 324, parallel to the axis V.

Before said protrusion 322, a further straight stretch 325 is provided on the same directrix as the stretch 323, in other words, orthogonal to the axis V.

The continuity of the straight stretches 323, 325 is interrupted by the protrusion 322.

The core 32 comprises a central cavity 326, preferably with a rectangular section cut in half by the axis V.

Said straight stretches 324 are part of a stem 327 of the core 32, further comprising two connection protrusions 36, which develop from the bottom of the stem 327, inclined with respect to the axis V and diverging if we consider the same axis V in the direction of the central cavity 326.

Said single stem 327 is joined in one piece to a head 328 of the insert 3. The head 328 corresponds to the core portion 32 housed in the profile 31.

The core 32, and consequently the whole insert 3, adopts a mushroom shape with the stem 327 and the head 328.

Each protrusion 36 comprises two straight stretches 361, parallel to each other, and joined by a further straight stretch 362, able to interact with the respective protrusion 25 of the base 2.

Said straight stretch 362 is orthogonal to the axis V.

A first of said straight stretches 361 is connected to said straight stretch 324 defining an acute angle (preferably less than 30°, even more preferably less than 20°), a second of said straight stretches 361 is connected to a straight base 363 of the stem 327.

The shape defined by said straight base 363 and by the straight stretches 361, external with respect to the axis V, is able to rest in a substantially complementary manner in a cavity 29 of the base 2. In particular, the base 363 is coupled to the second rectilinear portion 23 of the base 2, and each external straight stretch 361 rests on a respective inclined stretch 241.

As a result of said shape coupling, each straight stretch 362 of the stem 327 protrusion 36 abuts on the respective protrusion 25 of the base 2, in particular on the lower part of the curve 251, which terminates with an almost straight stretch, said curve 251 drawing an angle of 180°.

The insert 3 can be seen in FIG. 6 coupled by lock joint to the base 2.

The coupling is performed by forcing the insertion of the stem 327 into the cavity 29 of the base 2, in particular of the protrusions 36, so that, during insertion, said protrusions 36 bend inwards slightly (in other words, towards the axis V), passing the protrusions 25 of the base 2 and then, after insertion, they widen again, engaging below the curves 251 of the protrusions 25 of the base 2.

After coupling, the rectilinear stretches 34 rest on the straight stretches 252 and the connections 35 rest on the steps 28, the wings 27 thus performing a restraining action for the insert 3 in the direction of the axis V.

The lock joint coupling described above ensures the seal both in the direction of the axis V by the coupling of the protrusions 25 and 36, and in a direction orthogonal to said axis V by said wings 27, which push the profile 31 towards the axis V.

Advantageously, the flexibility of said protrusions 36 allows a quick assembly.

The complementarity of the stem 327 and the cavity 29 allows the fender to bend without the risk of breaking.

The spaces 325 further increase the flexibility of the insert 3 ensuring a minimum clearance between the core 32 and the profile 31.

With respect to the fender 1 described in FIGS. 1-4, in the fender 1 of FIGS. 5-8 the shape of the base 2 is simpler: note, for example, the closed cavities 26, which, based on the present invention, have a circular section. Manufacturing is thus facilitated while achieving the object of reducing the weight thereof and maintaining a positive flexibility for adapting to significant curves of the hull.

Unlike the fender 1 in the first embodiment, the insert 3 of the second embodiment comprises a central cavity 326, which allows a reduction in the weight of the stem 327, increasing flexibility in a critical area.

Advantageously, the protrusions 25 of the base 2 are of a reduced size, thus improving the resistance of the coupling to the protrusions 36 of the insert 3.

With reference to both embodiments, the insert 3 is solid due to the profile 31 made of steel, but has a reduced weight because of the core 32 made of PVC.

The insert 3 is obtained by bending a stainless steel belt (for example 316 L of 1 mm) around the core 32 made of PVC (for example vinyl chloride with a hardness of 100 shore), as shown in FIG. 3 where the profile 31 corresponds to the bent stainless steel belt.

The base 2 and the core 32, both made of plastic material (for example PVC), are obtained by a procedure of extrusion.

The profile 31 can be made of another metal material, for example non-stainless steel or aluminum to increase the lightness, however at the expense of the strength.

The fender 1 consisting of said base 2 and said insert 3 is thus modular and adaptable to any curve of the hull of the boat, possibly also a jet ski.

The coupling of the insert 3 to the base 2 is performed simply by lock joint, without separate fixing means, such as screws, rivets or similar.

Advantageously, the insert 3 can easily be removed for maintenance or replacements.

The invention claimed is:

1. A fender for boats contains a base made of plastic material to be fixed to a hull of a boat, an insert to be coupled to the base, the insert composed of a profile made of metal and a core made of plastic material, wherein said insert is removably coupled by a lock joint to the base, wherein the profile is formed by a curved stretch and two rectilinear stretches converging towards each other, the curved stretch is connected with continuity to each rectilinear stretch, wherein the core comprises a head and connection means, and wherein the profile encompasses the head of the core, and the connection means extend between ends of the rectilinear stretches towards connection means of the base to which the connection means of the core is able to be coupled by lock joint.

2. The fender according to claim 1, wherein the base comprises at least one connection protrusion able to be coupled by a lock joint to at least one connection protrusion of the insert.

3. The fender according to claim 2, wherein at least one connection protrusion of the insert is part of the core.

4. The fender according to claim 3, wherein the base and the insert are symmetrical with respect to an axis, the core of the insert comprises a head and a stem, which comprises two connection protrusions, which develop from the bottom of the stem, inclined with respect to the axis, and diverging from the axis in the direction of the head of the core.

5. The fender according to claim 4, wherein each protrusion of the insert comprises two straight stretches, parallel to each other, connected by a further straight stretch, able to interact with the respective protrusion of the base.

6. The fender according to claim 5, wherein each connection protrusion of the base comprises a curve below which a respective straight stretch engages.

7. The fender according to claim 6, wherein the curve continues at the bottom in inclined stretches joined to one another by a rectilinear portion forming a cavity in the base, a first of the straight stretches of each connection protrusion of the insert is connected to a straight stretch of the stem, defining an acute angle, a second of the straight stretches of each connection protrusion of the insert is connected to a straight base of the stem, the shape defined by the straight base and by the straight stretches, external with respect to the axis, is able to rest in a substantially complementary manner in the cavity of the base, the straight base coupled to the rectilinear portion of the base and each external straight stretch resting on a respective inclined stretch.

8. The fender according to claim 7, wherein the profile is formed by a curved stretch and two rectilinear stretches converging towards the same axis, the curved stretch is connected with continuity to each rectilinear stretch by connections, the core has a curved edge, which follows the curved stretch of the profile with contact, a space is provided, at each rectilinear stretch of the profile, between the rectilinear stretch and the core, interrupted by a rest protrusion beyond which the core continues until the upper end of the stem.

9. The fender according to claim 8, wherein the core continues with a rectilinear stretch beyond the protrusion, connecting at 90° to a straight stretch of the stem, parallel to the axis before the protrusion, from the stem, a further straight stretch on the same directrix as the stretch, orthogonal to the axis, the continuity of the straight stretches being interrupted by the protrusion.

10. The fender according to claim 8, wherein each curve continues laterally along a straight stretch up to a lateral wing, determining a step, upon completion of coupling the rectilinear stretches resting on the straight stretches and the connections resting on the steps.

11. The fender according to claim 1, wherein the core comprises a central cavity.

12. The fender according to claim 1, wherein the base comprises closed lateral cavities with a circular section.

13. The fender according to claim 3, wherein the profile is formed by a curved stretch and two rectilinear stretches converging towards an axis of symmetry of the insert, the curved stretch being connected with continuity to each rectilinear stretch by connections, the core has an edge, which follows the profile and covers it until ends of the rectilinear stretches of the profile, the base is symmetrical with respect to the same axis of symmetry as the insert and comprises two connection protrusions, two closed lateral cavities, a central open cavity, and two lateral wings, each connection protrusion and the respective wing determining an open lateral cavity, the core comprises two connection protrusions, which develop between the ends of the profile, the connection protrusions of the insert coupled by a lock joint to respective connection protrusions of the base so as to close the central cavity of the base and allow the profile of the insert to rest on the wings of the base, closing the lateral cavities of the base.

14. The fender according to claim 13, wherein each lateral wing of the base is formed by one end of a curved lateral portion of the base and a curved stretch, which meet, forming a tip, the profile of the insert being able to slide on the curved stretch.

15. The fender according to claim 14, wherein each connection protrusion of the base comprises one end able to be coupled to a respective groove of a respective connection protrusion of the insert, and a tooth able to be coupled to a respective end of the profile of the insert.

16. The fender according to claim 14, wherein each protrusion of the insert comprises two rectilinear stretches, which meet in a connection.

17. The fender according to claim 14, wherein the protrusions of the insert comprise grooves facing one another.

18. The fender according to claim 17, wherein each protrusion of the insert comprises a pair of grooves, which defines a constriction.

19. The fender according to claim 13, wherein each closed lateral cavity of the base is delimited by two curved stretches facing each other and connected by two straight stretches.

* * * * *